US005645246A

United States Patent [19]

Sugioka et al.

[11] Patent Number: 5,645,246

[45] Date of Patent: Jul. 8, 1997

[54] BOBBIN HOLDER

[75] Inventors: Takami Sugioka; Noriki Ishimaru, both of Matsuyama, Japan

[73] Assignee: Teijin Seiki Co., Ltd., Osaka-fu, Japan

[21] Appl. No.: 703,783

[22] Filed: Sep. 4, 1996

Related U.S. Application Data

[63] Continuation of Ser. No. 283,056, Jul. 29, 1994, abandoned.

[30] Foreign Application Priority Data

Jul. 31, 1993 [JP] Japan ..... 5-208246

[51] Int. Cl.[6] ..... B65H 75/24

[52] U.S. Cl. ..... 242/573.7

[58] Field of Search ..... 242/573.9, 573, 242/573.2, 573.7; 279/2.11, 2.12, 2.13, 2.14, 2.15; 269/48.1, 48.2, 48.3, 48.4

[56] References Cited

U.S. PATENT DOCUMENTS

| | | | |
|---|---|---|---|
| 1,466,121 | 8/1923 | Dallas | 242/573.7 |
| 2,453,717 | 11/1948 | Long | 279/2.13 |
| 2,922,592 | 1/1960 | Kaltenbach | 279/2.11 |
| 3,552,673 | 1/1971 | Evers | 242/573.2 |
| 4,107,969 | 8/1978 | Okabe et al. | 242/573.2 X |
| 4,254,920 | 3/1981 | Peterson | 242/573.7 |
| 4,307,851 | 12/1981 | Dunaevsky et al. | 242/573 |

FOREIGN PATENT DOCUMENTS

| | | |
|---|---|---|
| 0217276 | 4/1987 | European Pat. Off. . |
| 0335254 | 10/1989 | European Pat. Off. . |
| 2854715 | 10/1979 | Germany . |
| 3044315 | 11/1980 | Germany . |
| 55-123847 | 9/1980 | Japan . |
| 60-1766 | 1/1985 | Japan . |
| 60-43667 | 3/1985 | Japan . |

*Primary Examiner*—John M. Jillions

*Attorney, Agent, or Firm*—Rothwell, Figg, Ernst & Kurz, P.C.

[57] ABSTRACT

A bobbin holder mounted on a yarn winding machine includes a plurality of chucking members disposed at an outer periphery of the holder. The chucking members are expanded radially outwardly so as to engage an inner side of a cylindrical bobbin coaxially inserted onto the holder when they are longitudinally compressed. The chucking members release the bobbin when they are moved radially inwardly. The portions on the holder for receiving the chucking members are formed as concaves, with a part of each chucking member inserted into a respective concave.

12 Claims, 4 Drawing Sheets

BOBBIN HOLDER

This is a continuation of application Ser. No. 08/283,056, filed Jul. 29, 1994, now abandoned.

BACKGROUND OF THE INVENTION

1. Field of the Invention

The present invention relates to a bobbin holder onto which a cylindrical bobbin is inserted and held thereby, which bobbin holder is mounted on a winding machine and wherein a yarn is wound onto the bobbin. The bobbin holder of the present invention is especially suitable for a winding machine for winding a spun synthetic yarn such as a polyester or polyamide yarn at a speed, for example, of several thousand m/min.

2. Description of the Prior Art

Recently, there is a trend tendency in a constructing yarn winding apparatus to reduce the diameter of a bobbin. Accordingly, the diameter of a bobbin holder is also reduced, and at the same time the length of the bobbin holder increases as its winding speed increases. Recently developed bobbin holders mounted on such a winding machine are disclosed, for example, in Japanese Utility Model Applications Laid-open No. Sho 60-43667 and No. Sho 60-1766, and Japanese Patent Application Laid-open No. Sho 55-123847.

Since a chucking member is inserted onto an outside of a supporting shaft or a holder in such conventional bobbin holders, the outer diameter of the shaft or the holder is equal to a size which is obtained from an inner diameter of the bobbin after the necessary size for the chucking member is excluded. Therefore, the outer diameter of the shaft or the holder decreases. Thus, the rigidity of the shaft or the holder is lowered, and natural vibration of the bobbin holder occurs in the operational range of the bobbin holder. Accordingly, as illustrated in FIG. 8, the vibration becomes large at an operational range above a speed of 10,000 rpm. As a result, there is a problem in that the bobbin holder cannot be rotated in such a high operational range. Accordingly, the winding machine cannot be operated at a high speed.

OBJECTS OF THE INVENTION

It is an object of the present invention to provide a bobbin holder having a small diameter and a long length which can overcome the problems inherent to the above-described conventional bobbin holders.

It is another object of the present invention to provide a bobbin holder having a small diameter and a long length which can be operated at a high speed.

SUMMARY OF THE INVENTION

According to the present invention, the above-described object is achieved by a bobbin holder mounted on a yarn winding machine which bobbin holder comprises a plurality of chucking members disposed at an outer periphery of a supporting shaft. The chucking members are expanded radially outwardly so as to chuck an inner side of a cylindrical bobbin coaxially inserted onto the supporting shaft when they are longitudinally compressed, and the chucking members release the bobbin when they are moved radially inwardly, characterized in that portions around the supporting shaft for supporting the chucking members are formed as concave, and a part of a respective chucking member is inserted into a respective concave.

According to the present invention, the portions around the supporting shaft for supporting the chucking member, i.e., the portions on the supporting shaft itself or the portions on the holder integrally inserted onto the supporting shaft, are formed as concave and a part of a chucking member is inserted into the concave. When the thickness of the chucking member is unchanged, the outer diameter of the shaft or the holder can be increased via the invention compared with that applied to a conventional bobbin holder. Accordingly, the rigidity of the shaft or the holder is enhanced. As a result, the natural frequency of the bobbin holder becomes high, and the operational speed of a bobbin holder having a small outer diameter and a long length can be increased.

The degree of improvement of the natural frequency relative to a conventional apparatus increases as the ratio between the concave and the length of the bobbin holder decreases.

BRIEF DESCRIPTION OF THE DRAWINGS

The present invention will now be explained in detail referring to the attached drawings wherein.

DESCRIPTION OF PREFERRED EMBODIMENTS

Figure 1:
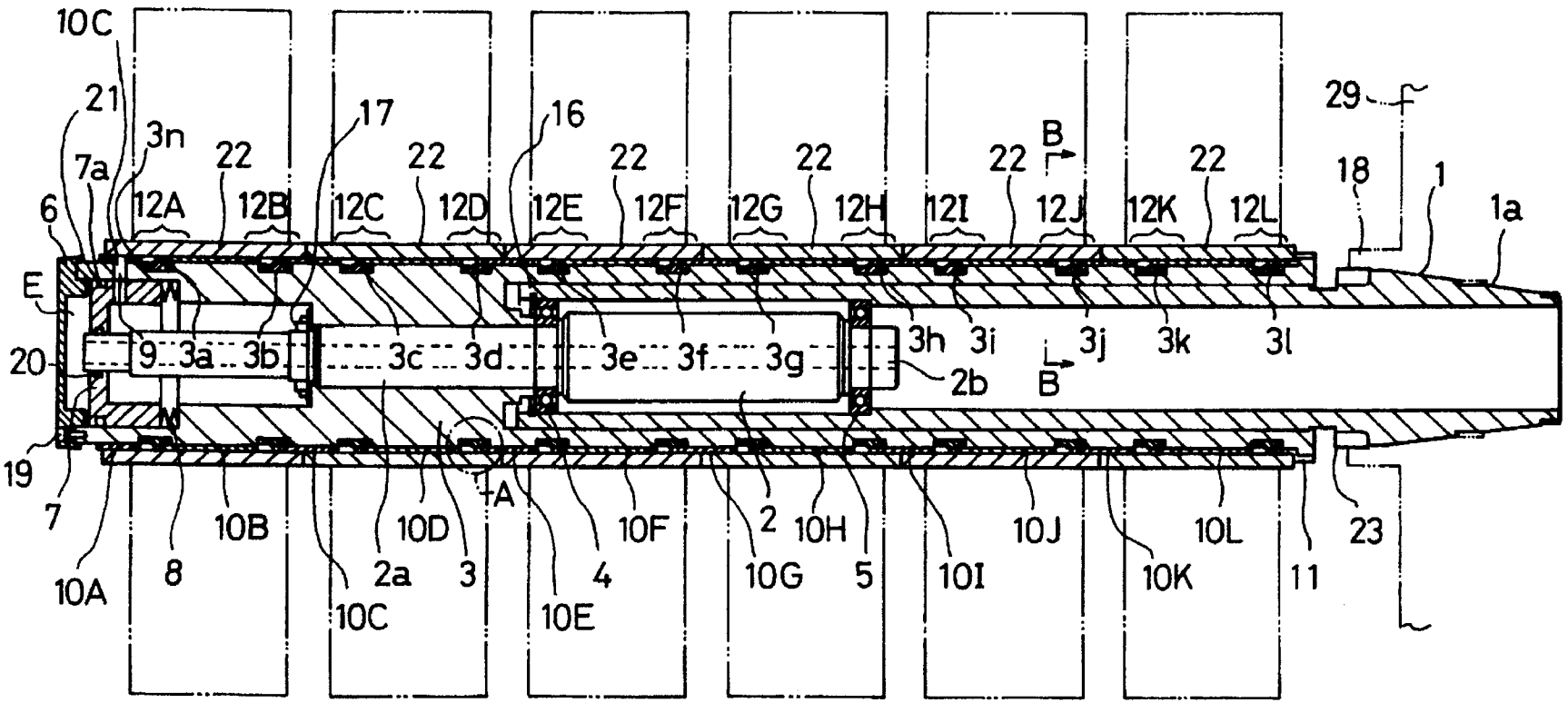
FIG. 1 is a cross sectional view of an embodiment of a bobbin holder according to the present invention.

Referring to FIG. 1, which illustrates a cross sectional view of an embodiment of a bobbin holder according to the present invention, a tapered portion 1*a* is formed at the right end of a hollow supporting shaft 1 which is engaged with a frame 18 of a winding machine and is supported by the latter. Reference numeral 23 denotes a nut, and the tapered portion 1*a* of the supporting shaft 1 is fixedly secured to the frame 18 by threading the nut 23. A shaft 2 is coaxially supported in the hollow portion of the supporting shaft 1 by means of bearings 4 and 5 and is rotatable relative to the supporting shaft 1. Reference numeral 16 denotes a stop ring of the bearing 4.

The longitudinal center 2*a* of the shaft 2 engages with an aperture formed in a holder 3 providing an interference between the shaft 2 and the holder 3, and the shaft 2 and holder 3 are integrally secured by means of a nut 17. The shaft 2 has a longitudinal hole 2*b* coaxially formed at the axial center thereof, and compressed air is supplied from the rear portion of the shaft 2 through the longitudinal hole 2*b* when a bobbin is disengaged.

Figure 2:
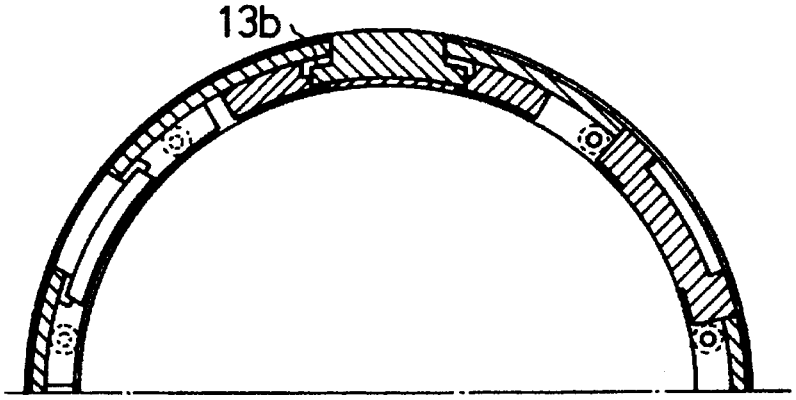
FIG. 2 is a cross sectional view taken along line B—B in FIG. 1.
Figure 3:
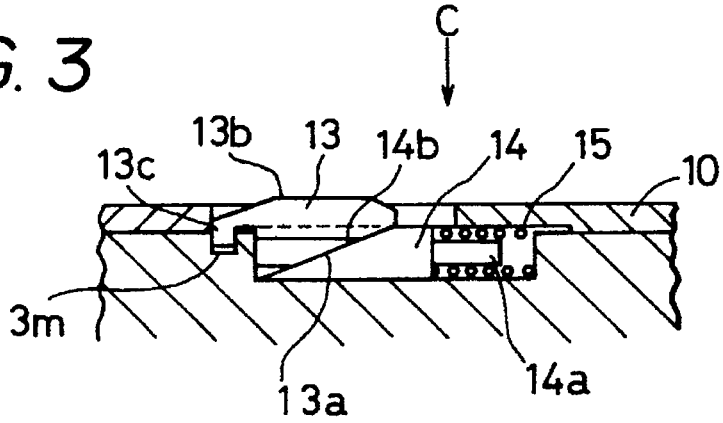
FIG. 3 is a detailed view of portion A in FIG. 1.

The holder 3 is formed in a cylindrical shape and secured to the longitudinal center 2*a* of the shaft 2 as described above. The holder 3 has a plurality of concaves 3*a*–3*l* formed at the outer surface thereof spaced in the lengthwise direction of the holder 3. Each of the concaves 3*a*–3*l* circumferentially encircles the periphery of the holder 3 as illustrated in FIG. 2. As illustrated in FIG. 3, channels 3*m* are formed at the outer surface of the holder 3 at portions axially adjacent to the concaves 3*a*–3*l*.

A cap 6 is secured to the front end of the holder 3 by means of bolts 19 so that a cylindrical chamber E is formed. A piston is sealingly and slidably fitted to the front end of the shaft 2 via an O-ring 20. An O-ring 21 is engaged into an O-ring engaging groove 7*a* formed at the outer surface of the piston 7. Thus, the piston 7 is slidably and sealingly engaged with a cavity formed at the front end of the holder 3 via the O-ring 21.

A spring 8 is disposed between the front end of the holder 3 and the piston 7 so that the piston 7 is urged to the left in FIG. 1. Three pins 9 equidistantly spaced around the peripheral surface of the piston 7 are screw threaded to the surface of the piston 7. The pins 9 penetrate the holes 3*n* which are elongated in an axial direction and which are formed in the holder 3 and engage with the holes 10*c* formed in a sleeve 10A. The sleeve 10A slidably engages with the outer peripheral surface of the holder 3 and has the above-described three holes 10*c* equidistantly formed around the periphery thereof.

In addition to the above-described sleeve 10A, cylindrical sleeves 10B, 10C, 10D, 10E, 10F, 10G, 10H, 10I, 10J, 10K, and 10L, and endmost shoulder sleeve 11, are successively and slidably inserted onto the holder 3 so that they axially align with each other.

Chucking members 12A–12L which engage and disengage bobbins are disposed in the above-described concaves 3*a*–3*l*. In the following description, the sleeves 10A–10L are merely referred to as "sleeve 10."

Reference numeral 10*b* denotes a notch which is formed in the sleeve 10 in such a manner that it is perpendicular to a notch 10*a* form a T shape. When the bobbin 22 is disengaged, the notch 10*b* engages with the projections 14*c* and 14*d* formed on the tapered member 14 so that the tapered member 14 is moved to the right in FIG. 1.

The construction of the chucking members 12A, 12B, 12C, 12D, 12E, 12F, 12G, 12H, 12I, 12J, 12K and 12L will now be explained referring to FIGS. 3 and 4.

A chuck 13 has an outer surface 13*b* for engaging with and holding the inner surface of the bobbin 22. The tapered surface 13*a* formed in the inner surface of the chuck 13 engages with the tapered surface 14*b* of the tapered member 14 and radially expands the chuck 13. Then, the outer surface 13*b* of the chuck engages with the inner surface of the bobbin 22 and holds the bobbin 22. In FIG. 3, a hook 13*c* is formed at the left end of the chuck 13, and the hook 13*c* engages with the groove 3*m* formed near the concaves 3*a*–3*l* of the holder 3.

The tapered members 14 are disposed in the annular concaves 3*a*–3*l* which are formed in the holder 3, and springs 15 are fitted to pins 14*a* projecting from the right end of the tapered members 14 so that the tapered members 14 are moved to the left in FIGS. 1 and 3 by means of the spring 15 so as to expand the chucks 13.

Figure 4:
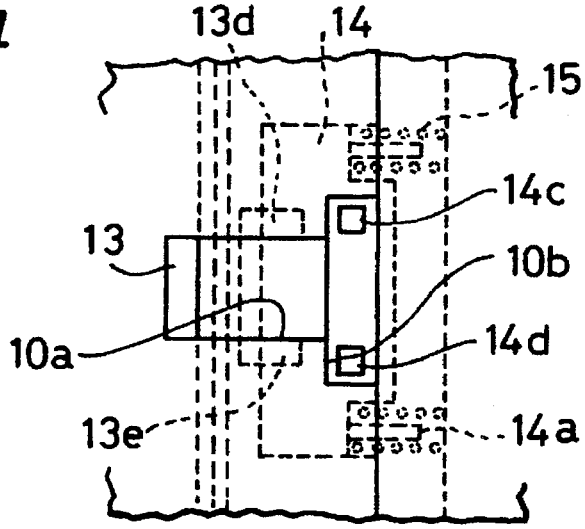
FIG. 4 is a plan view along arrow C in FIG. 3.

In FIG. 4, reference numeral 10*a* denotes a notch formed in the sleeve 10 and extending in an axial direction of the sleeve 10. The chuck 13 projects through the notch 10*a*. In the present embodiment, six chucks 13 are assigned to each of the annular concaves 3*a*–3*l*, and the notches 10*a* are formed in such a manner that they equidistantly divide the outer periphery of the respective sleeve 10. Further, reference numerals 13*d* and 13*e* denote projections formed at the sides of the chuck 13, and the projections 13*d* and 13*e* engage with the inner side of the sleeve 10 so that they prevent the tapered member 14 from projecting beyond the predetermined amount.

The operation of the bobbin holder which has the above-described construction will now be explained.

Engagement of Bobbin

The compressed air in the cylinder chamber E is exhausted, and the piston 7 is moved to the left in FIG. 1 by means of the spring 8. Accordingly, the sleeve 10A is moved to the left so that the engagement between each of sleeves 10A–10L and the respective projections 14*c* and 14*d* of the tapered member 14 is disengaged, i.e., the tapered member 14 becomes free from the sleeve 10.

Under this condition, then, the tapered member 14 is moved to the left in FIG. 1 by means of the spring 15, and the tapered surface 14*b* engages with the tapered portion 13*a* of the chuck 13 so that the chuck 13 is expanded outwardly. As a result, the chuck 13 holds the inner side of the bobbin 22.

Disengagement of Bobbin

A compressed air supplying nozzle (not shown) is pressed to the rear end, i.e., the right end in FIG. 1, of the shaft 2, and compressed air is supplied to the cylinder chamber E through the hole 2*b* formed in the shaft 2 so that the piston 7 is moved to the right in FIG. 1. Due to the movement of the piston 7, the sleeves 10A–10L are moved to the right via the pins 9. Thus, the walls of notches 10*b* formed in the respective sleeve 10 engage with the projections 14*c* and 14*d* of the tapered member 14, and the tapered member 14 is moved to the right in FIGS. 1, 3 and 4 against the force of the spring 15.

As described above, the tapered member 14 moves to the right in FIG. 1 against the force of the spring 15, and the the engaging portion, i.e., the tapered surface 13*a*, slides relative to the tapered member 14, and the chuck 13 is radially contracted.

According to the present embodiment, the portions around the supporting shaft for receiving the chucking members are formed as concaves and a part of each of the chucking members is inserted into a concave. Thus, the outer diameter of the shaft or the holder can be increased and the rigidity of the shaft or the holder is thereby enhanced. The rigidity of the shaft could be enhanced to about 1.5 times (and, if some designs are altered, between 1.4 and 1.7 times) that obtained by a conventional apparatus without chucking members disposed in concaves. As a result, the natural frequency of the bobbin holder becomes high, and the figure relating to the vibration, such as amplitude, at a high operational speed can be low even though a bobbin holder having a small outer diameter and a long length is used.

Figure 7:
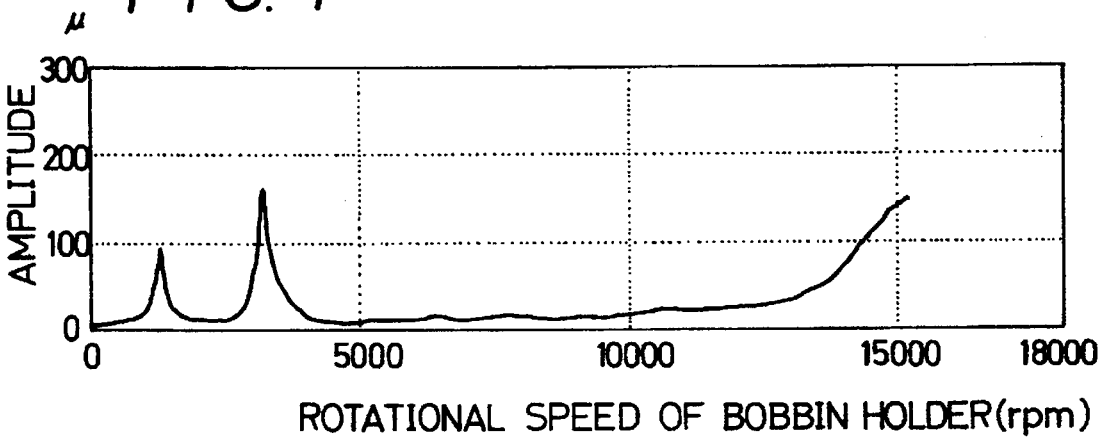
FIG. 7 is a diagram showing vibration of a bobbin holder according to the embodiment illustrated in FIG. 1 upon rotation of the holder.
Figure 8:
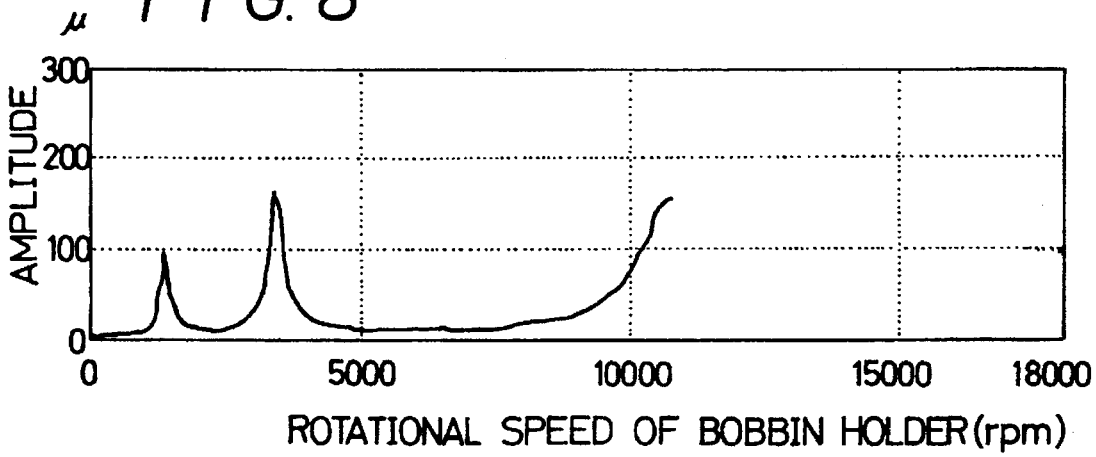
FIG. 8 is a diagram showing vibration of a bobbin holder according to conventional technology upon rotation of the holder.

When six bobbins having an inner diameter of 94 mm are held (the total length of 1,200 mm), the apparatus of the present embodiment was substantially free from a large vibration below a speed of 15,000 rpm as illustrated in FIG. 7, while the vibration increased remarkably at an operational range beyond a speed of about 10,000 rpm in a conventional apparatus as illustrated in FIG. 8.

Although the sleeves inserted onto the holder are not connected to each other in an axial direction in the above-described embodiment, they may be connected to each other, for example by means of suitable engaging members, such as projections.

Although the concaves are formed in the holder which is supported on the supporting shaft in the above-described embodiment, the concaves may be formed on the supporting shaft when the present invention is carried out in an apparatus wherein a bobbin holder is not used and the chucking members are directly inserted onto the supporting shaft.

Figure 5:
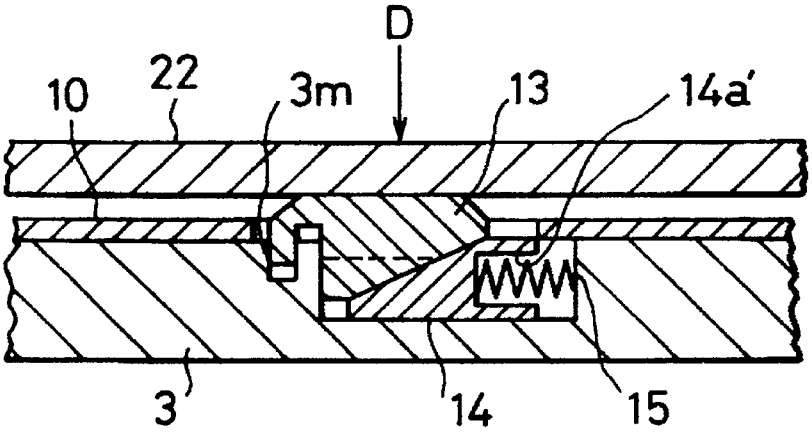
FIG. 5 is a detailed view of another embodiment corresponding to portion A.
Figure 6:
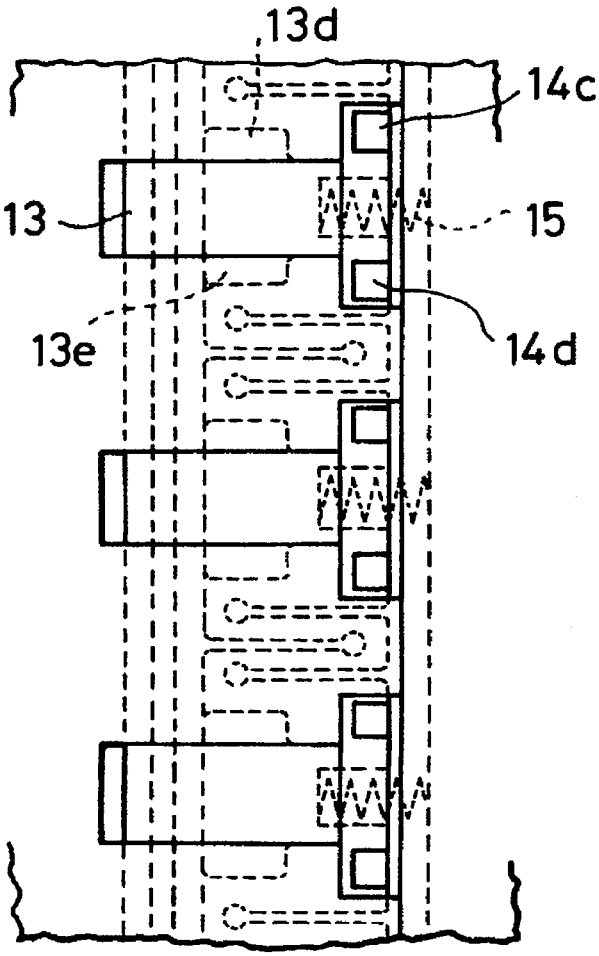
FIG. 6 is a plan view along arrow D in FIG. 5.

Another embodiment of the invention is illustrated in FIGS. 5 and 6. Although the springs 15 are fitted to the pins 14*a* projecting from the tapered portion 14 in the above-described embodiment, the tapered member 14 has an cavity 14*a*' formed therein in this embodiment, and a spring 15 is fitted in the cavity 14*a*' (as shown in FIGS. 5 and 6).

According to the present invention, springs may be engaged with the sleeves 10*b*–10*l* or only the sleeve 11 so that the sleeves 10*b*–10*l* are moved to the left by the spring force when the bobbins are disengaged.

Although the sleeves are pressed from the front end of the holder when the bobbins are disengaged in the above-described embodiments, the chucking members may be arranged in such a manner that they are pressed from the rear end by an actuator disposed at the rear end of the holder or the outside of the holder.

Figure 9:
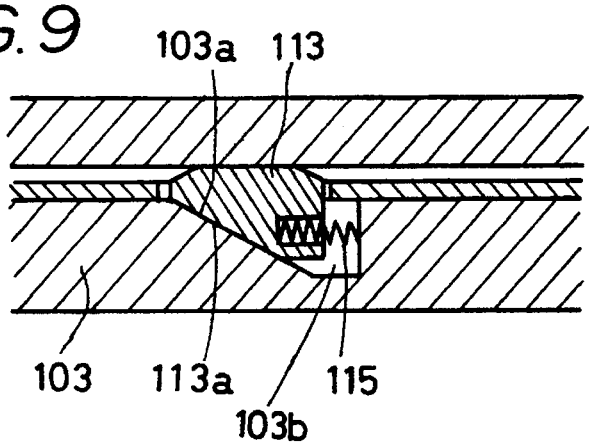
FIG. 9 is a detailed view of a still another embodiment corresponding to portion A.

A detailed view of a portion corresponding to portion A in a further embodiment is illustrated in FIG. 9. According to the present invention, a tapered portion 103*a* may be formed on a concave groove 103*b* of a holder 103, and a tapered portion 113*a* of a chuck 113 may be engaged with the tapered portion 103*a*. Reference numeral 115 denotes a spring disposed at a space between the holder 103 and the chuck 113 to urge the chuck 113 to the left in FIG. 9.

According to the present invention, the portions around the supporting shaft in which the chucking members are disposed are formed as concaves and a part of a chucking member is inserted into a concave. Thus, the outer diameter of the shaft or the holder can be increased and the rigidity of the shaft or the holder can be enhanced. According to the present invention, the rigidity can be remarkably enhanced compared with a conventional apparatus which does not include portions in the supporting shaft for receiving the chucking members. As a result, the natural frequency of the bobbin holder becomes high, and the figure relating to the vibration, such as amplitude, at a high operational speed can be low even though a bobbin holder having a small outer diameter and a long length is used.

What is claimed is:

1. A bobbin holder for mounting a yarn-winding bobbin on a yarn winding machine, the bobbin holder comprising:

a supporting shaft;

a unitary tubular holder secured to the supporting shaft so as to be axially non-movable with respect thereto, said tubular holder configured to support the bobbin coaxially therewith and having a generally cylindrical outer surface and a plurality of axially spaced concaves formed as circumferentially oriented depressions in said outer surface; and a plurality of chucking members arranged with at least a portion of each said chucking member disposed in a corresponding one of said concaves, said chucking members being configured to move radially outwardly upon being pressed in a longitudinal direction so as to engage an inner surface of the bobbin to secure the bobbin on the tubular holder and also to move radially inwardly to release the bobbin when not being pressed in said longitudinal direction, whereby said tubular holder withstands radial loads caused by said chucking members when said chucking members move radially outwardly and engage said inner surface of the bobbin, said bobbin holder further comprising a plurality of pressing members disposed at least partially within said concaves to effect radially outward movement of said chucking members by pressing said chucking members in said longitudinal direction, and one or more sleeves inserted onto the tubular holder radially outwardly of said concaves and axially displaceable relative to the tubular holder, said sleeves being configured to disrupt pressing engagement between said pressing members and said chucking members upon axial displacement of said sleeves.

2. A bobbin holder for mounting a yarn-winding bobbin on a yarn winding machine, the bobbin holder comprising:

a unitary supporting shaft for supporting the bobbin coaxially with said supporting shaft, said supporting shaft having a generally cylindrical outer surface and a plurality of axially spaced concaves formed as circumferentially oriented depressions in said outer surface; and a plurality of chucking members arranged with at least a portion of each said chucking member disposed in a corresponding one of said concaves, said chucking members being configured to move radially outwardly upon being pressed in a longitudinal direction so as to engage an inner surface of the bobbin to secure the bobbin on the supporting shaft and also to move radially inwardly to release the bobbin when not being pressed in said longitudinal direction, whereby said supporting shaft withstands radial loads caused by said chucking members when said chucking members move radially outwardly and engage said inner surface of the bobbin.

3. A bobbin holder according to claim 2, further comprising a plurality of pressing members disposed at least partially within said concaves to effect radially outward movement of said chucking members by pressing said chucking members in said longitudinal direction.

4. A bobbin holder for mounting a yarn-winding bobbin on a yarn winding machine, the bobbin holder comprising:

a unitary supporting shaft for supporting the bobbin coaxially with said supporting shaft, said supporting shaft having a generally cylindrical outer surface and a plurality of axially spaced concaves formed as circumferentially oriented depressions in said outer surface; and a plurality of chucking members arranged with at least a portion of each said chucking member disposed in a corresponding one of said concaves, said chucking members being configured to move radially outwardly upon being pressed in a longitudinal direction so as to engage an inner surface of the bobbin to secure the bobbin on the supporting shaft and also to move radially inwardly to release the bobbin when not being pressed in said longitudinal direction, whereby said supporting shaft withstands radial loads caused by said chucking members when said chucking members move radially outwardly and engage said inner surface of the bobbin, said bobbin holder further comprising circumferentially oriented channels formed as depressions in said outer surface axially adjacent to said concaves, said chucking members having hooks which engage said channels.

5. A bobbin holder according to claim 4, further comprising a plurality of pressing members disposed at least partially within said concaves to effect radially outward movement of said chucking members by pressing said chucking members in said longitudinal direction.

6. A bobbin holder according to claim 5, further comprising one or more sleeves inserted onto the supporting shaft radially outwardly of said concaves and axially displaceable relative to the supporting shaft, said sleeves being configured to disrupt pressing engagement between said pressing members and said chucking members upon axial displacement of said sleeves.

7. A bobbin holder for mounting a yarn-winding bobbin on a yarn winding machine, the bobbin holder comprising:

a unitary supporting shaft for supporting the bobbin coaxially with said supporting shaft, said supporting shaft having a generally cylindrical outer surface and a plurality of axially spaced concaves formed as circumferentially oriented depressions in said outer surface; and a plurality of chucking members arranged with at least a portion of each said chucking member disposed in a corresponding one of said concaves, said chucking members being configured to move radially outwardly upon being pressed in a longitudinal direction so as to engage an inner surface of the bobbin to secure the bobbin on the supporting shaft and also to move radially inwardly to release the bobbin when not being pressed in said longitudinal direction, whereby said supporting shaft withstands radial loads caused by said chucking members when said chucking members move radially outwardly and engage said inner surface of the bobbin, said bobbin holder further comprising a plurality of pressing members disposed at least partially within said concaves to effect radially outward movement of said chucking members by pressing said chucking members in said longitudinal direction, and one or more sleeves inserted onto the supporting shaft radially outwardly of said concaves and axially displaceable relative to the supporting shaft, said sleeves being configured to disrupt pressing engagement between said pressing members and said chucking members upon axial displacement of said sleeves.

8. A bobbin holder for mounting a yarn-winding bobbin on a yarn winding machine, the bobbin holder comprising:

a supporting shaft;

a unitary tubular holder secured to the supporting shaft so as to be axially non-movable with respect thereto, said tubular holder configured to support the bobbin coaxially therewith and having a generally cylindrical outer surface and a plurality of axially spaced concaves formed as circumferentially oriented depressions in said outer surface; and a plurality of chucking members arranged with at least a portion of each said chucking member disposed in a corresponding one of said concaves, said chucking members being configured to move radially outwardly upon being pressed in a longitudinal direction so as to engage an inner surface of the bobbin to secure the bobbin on the tubular holder and also to move radially inwardly to release the bobbin when not being pressed in said longitudinal direction, whereby said tubular holder withstands radial loads caused by said chucking members when said chucking members move radially outwardly and engage said inner surface of the bobbin.

9. A bobbin holder according to claim 8, further comprising a plurality of pressing members disposed at least partially within said concaves to effect radially outward movement of said chucking members by pressing said chucking members in said longitudinal direction.

10. A bobbin holder for mounting a yarn-winding bobbin on a yarn winding machine, the bobbin holder comprising:

a supporting shaft;

a unitary tubular holder secured to the supporting shaft so as to be axially non-movable with respect thereto, said tubular holder configured to support the bobbin coaxially therewith and having a generally cylindrical outer surface and a plurality of axially spaced concaves formed as circumferentially oriented depressions in said outer surface; and a plurality of chucking members arranged with at least a portion of each said chucking member disposed in a corresponding one of said concaves, said chucking members being configured to move radially outwardly upon being pressed in a longitudinal direction so as to engage an inner surface of the bobbin to secure the bobbin on the tubular holder and also to move radially inwardly to release the bobbin when not being pressed in said longitudinal direction, whereby said tubular holder withstands radial loads caused by said chucking members when said chucking members move radially outwardly and engage said inner surface of the bobbin, said bobbin holder further comprising circumferentially oriented channels formed as depressions in said outer surface axially adjacent to said concaves, said chucking members having hooks which engage said channels.

11. A bobbin holder according to claim 10, further comprising a plurality of pressing members disposed at least partially within said concaves to effect radially outward movement of said chucking members by pressing said chucking members in said longitudinal direction.

12. A bobbin holder according to claim 11, further comprising one or more sleeves inserted onto the tubular holder radially outwardly of said concaves and axially displaceable relative to the tubular holder, said sleeves being configured to disrupt pressing engagement between said pressing members and said chucking members upon axial displacement of said sleeves.

* * * * *

UNITED STATES PATENT AND TRADEMARK OFFICE

CERTIFICATE OF CORRECTION

PATENT NO. : 5,645,246

DATED : July 8, 1997

INVENTOR(S) : Takami Sugioka et al.

It is certified that error appears in the above-indentified patent and that said Letters Patent is hereby corrected as shown below:

Col. 2, line 66, insert -- and -- after "thereof"; Col. 3, line 35, insert -- to -- after "10a".

Signed and Sealed this

Thirteenth Day of January, 1998

Bruce Lehman

*Attest:*

BRUCE LEHMAN

*Attesting Officer*

*Commissioner of Patents and Trademarks*